US005769043A

United States Patent [19]

Nitkiewicz

[11] Patent Number: 5,769,043

[45] Date of Patent: Jun. 23, 1998

[54] METHOD AND APPARATUS FOR DETECTING ENGINE VALVE MOTION

[75] Inventor: James A. Nitkiewicz, Newport News, Va.

[73] Assignee: Siemens Automotive Corporation, Auburn Hills, Mich.

[21] Appl. No.: 854,023

[22] Filed: May 8, 1997

[51] Int. Cl.[6] ..... F01L 9/04

[52] U.S. Cl. ..... 123/90.11; 73/117.3; 73/119; 251/129.01

[58] Field of Search ..... 123/90.11; 251/129.01, 251/129.02, 129.05, 129.1, 129.16; 73/117.3, 119

[56] References Cited

U.S. PATENT DOCUMENTS

| | | | |
|---|---|---|---|
| 4,957,074 | 9/1990 | Weissler, II et al. . | |
| 4,984,541 | 1/1991 | Kawamura . | |
| 5,069,422 | 12/1991 | Kawamura . | |
| 5,111,779 | 5/1992 | Kawamura | 123/90.11 |
| 5,115,772 | 5/1992 | Kawamura . | |
| 5,124,598 | 6/1992 | Kawamura . | |
| 5,592,905 | 1/1997 | Born | 123/90.11 |
| 5,596,956 | 1/1997 | Ogawa et al. . | |
| 5,690,064 | 11/1997 | Izuo | 123/90.11 |

*Primary Examiner*—Weilun Lo
*Attorney, Agent, or Firm*—Russel C. Wells

[57] ABSTRACT

A method of and apparatus for detecting engine valve motion are provided in an internal combustion engine having an electromechanical or electromagnetic valve actuator with a ferrous component that moves in a linear path with the reciprocating motion of an engine valve between its open and closed positions. The apparatus includes a stationary magnetic field source mounted in the actuator and having an axis aligned with the linear path and positioned such that, at its closest position of travel, the ferrous component alters the magnetic field flux of the magnetic field source. A sensor mounted in the longitudinal path between the stationary magnetic field source and the ferrous component and sufficiently spaced from the magnetic field source responds to an amplified change in magnetic field flux at its closest travel position, sensing the change in the magnetic field flux of the stationary magnetic field source caused by the presence and absence of the ferrous component in the closest travel position as an indicator of engine valve motion.

9 Claims, 1 Drawing Sheet

METHOD AND APPARATUS FOR DETECTING ENGINE VALVE MOTION

FIELD OF THE INVENTION

This invention relates to electromagnetic valve timing actuators and more particularly to a method and apparatus that detects movement of a ferrous component in the actuator that moves in the same fashion as an associated intake or exhaust valve to provide information about the valve lift profile.

BACKGROUND OF THE INVENTION

It is known in the art relating to internal combustion engines to have an electromechanical or electromagnetic valve actuator to drive intake and/or exhaust valves by springs and solenoids to their open and closed positions. Furthermore, control systems have been employed in these actuators which sense valve lift. This sensed valve lift is used as an input in a closed loop control scheme as part of an engine management controller.

Typically, this sensing is performed by a sensor, such as Hall effect sensor, mounted along side the valve stem, or along side the armature that drives the valve between open and closed positions. In the case of the sensor being mounted along side the valve stem, there may be insufficient change in the magnetic field for accurate sensing of valve movement. In the case of the sensor being mounted along side the armature, there may be too much interference, caused by electromagnets acting on the armature to move the valve, to provide accurate sensor output.

SUMMARY OF THE INVENTION

The present invention provides an improved method and apparatus that optimizes the accuracy of valve motion measurement.

The present invention also provides for detecting a maximized change in magnetic flux due to valve motion and is removed from interference caused by electromagnets acting on an armature that moves the valve.

More specifically, the present invention provides a method of and apparatus for detecting engine valve motion in an internal combustion engine having an electromechanical or electromagnetic valve actuator with a ferrous component that moves in a linear path with the reciprocating motion of an engine valve between its open and closed positions. Therein, a stationary magnetic field source is mounted in or adjacent the actuator and has an axis aligned with the linear path and positioned such that at its closest position of travel, the ferrous component alters the magnetic field flux of the magnetic field source. A sensor mounted in the longitudinal path between the stationary magnetic field source and the ferrous component and is sufficiently spaced from the magnetic field source to respond to an amplified change in magnetic field flux at the closest travel position of the ferrous component. The sensor senses the change in the magnetic field flux of the stationary magnetic field source caused by the presence and absence of the ferrous component in the closest travel position as an indicator of engine valve motion.

According to the invention, the magnetic field source may be a permanent magnet located at one end of the valve actuator.

Preferably, the sensor is a linear Hall effect sensor and a non-magnetic spacer is mounted between the permanent magnet and Hall effect sensor. Any ferrous component that moves in the linear path and in the same fashion as that of the engine valve is capable of acting as the ferrous component. In this application the ferrous component is a shaft and spring retainer assembly displaced by the armature that drives the engine valve.

According to the invention, a method of detecting engine valve motion in an internal combustion engine having an electromechanical valve actuator with a ferrous component that moves in a linear path with reciprocating motion of an engine valve between open and close position comprises the steps of:

positioning a stationary magnetic field source with an axis aligned with the linear path and positioned such that at its closest position of travel, the ferrous component alters the magnetic field flux;

providing a sensor in the longitudinal path between the stationary magnetic field source and the ferrous component and sufficiently spaced from the magnetic field source to respond to an amplified change in the magnetic flux at the closest travel position of the ferrous component; and sensing the change in the magnetic field flux of the stationary magnetic field source caused by the presence and absence of the ferrous component in the closest travel position as an indicator of engine valve motion.

These and other features and advantages of the invention will be more fully understood from the following detailed description of the invention taken together with the accompanying drawings.

DETAILED DESCRIPTION OF THE INVENTION

Figure 1:
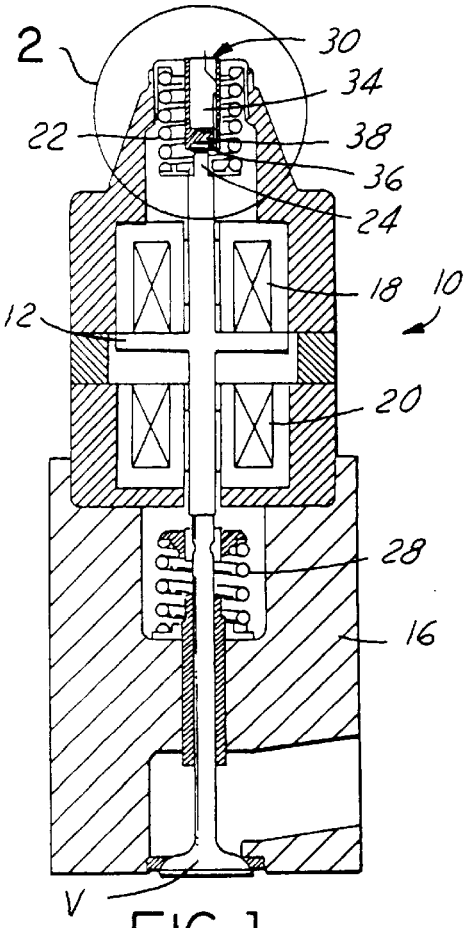
FIG. 1 is a sectional view of an electromechanical or electromagnetic valve timing actuator in accordance with the present invention.

Referring first to FIG. 1, there is illustrated the construction of an electromechanical or electromagnetic valve timing actuator 10 employed in an electromagnetically driven valve control system. As is hereinafter more fully described, the electromechanical valve actuator 10 drives in internal combustion engine intake and/or exhaust valve representively illustrated as valve V between open and closed positions through movement of an armature 12 mechanically connected to the valve V. The valve V is mounted in a head 16 of a cylinder block of an internal combustion engine as is known.

The valve actuator 10 includes two solenoids (electromagnets) which are opposed to each other in the longitudinal direction, i.e. a closing solenoid 18 for biasing the valve V in a closing direction and an opening solenoid 20 for biasing the valve in an open direction. A first spring 22 mounted in one end of the actuator 10 urges the armature 12 through a shaft and spring retainer assembly 24, toward an open position of the valve V. A second spring 28 mounted in the head 16 urges the valve V toward a closed position as is known. The first and second springs 22,28 are disposed such that their spring forces offset one another when the armature 12 is positioned in a balanced or neutral position between the solenoids 18,20.

By selectively energizing the closing solenoid and opening solenoids 18,20 with driving current, the valve V moves between a fully closed position in which the valve closes, and a fully open position of the valve.

Figure 2:
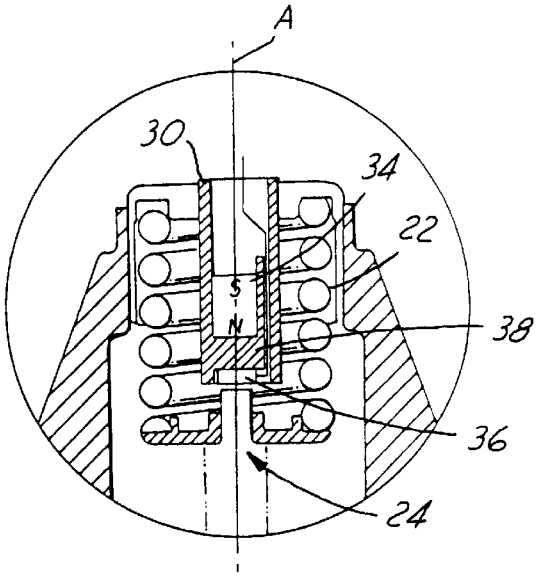
FIG. 2 is a enlarged sectional view of one end of the actuator of FIG. 1 illustrating the orientation of an insert including a permanent magnet, non-magnetic spacer and Hall effect sensor along a linear path of reciprocating valve motion and in relation to a ferrous component, the shaft and spring retainer of the valve timing actuator.

With continuing reference to FIG. 1 and with reference to FIG. 2 of the drawings, there is shown an insert 30 mounted along the longitudinal direction in an end of the valve actuator 10 distal from the other end mounted on the head 16. The insert 30 includes a permanent magnet 34 that provides a stationary magnetic field source having an axis A aligned with the linear path of reciprocating motion of the engine valve V between open and closed positions. The permanent magnet 34 is mounted such that, at its closest position of travel, the shaft and spring retainer assembly 24 alters the magnetic field flux of the magnet.

Figure 3:
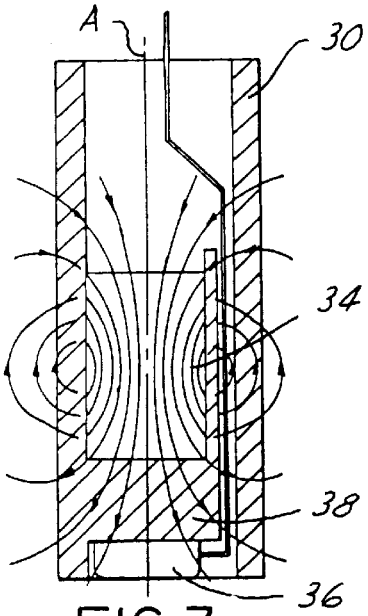
FIG. 3 is a enlarged, schematic view of the magnet, spacer, sensor assembly of FIG. 1 illustrating the normal magnetic flux path of the magnet when a ferrous component is not positioned near the sensor.
Figure 4:
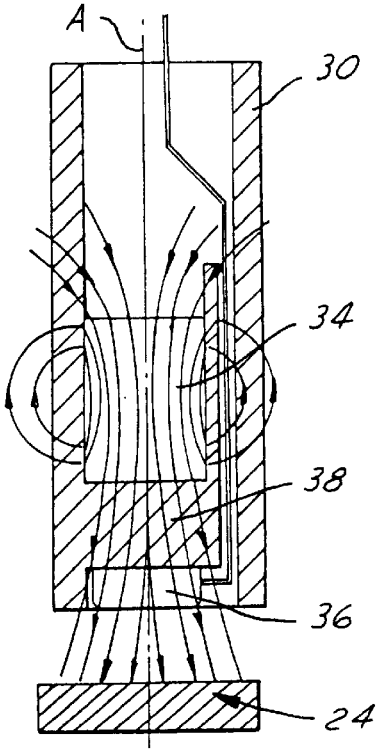
FIG. 4 is an enlarged, schematic view of the magnet, spacer, sensor assembly of FIG. 3 illustrating the magnetic flux path redirected by the ferrous component when the ferrous component is positioned close to the sensor.

A sensor 36, preferably a linear Hall effect sensor, is mounted in the insert 30 in the longitudinal path between the stationary magnetic field source of the permanent magnet 34 and the shaft and spring retainer assembly 24. The sensor 36 is sufficiently spaced, by a spacer 38, from the magnetic field source of the permanent magnet 34 to respond to an amplified change in magnetic field flux at the closest travel position of the assembly 24. FIG. 3 illustrates the magnetic field flux of the permanent magnet 34 when the ferrous component 24 is not in the closest travel position. The Hall effect sensor 36 senses the change in the magnetic field flux of the magnet caused by the presence and absence of the ferrous component, the shaft and spring retainer assembly 24, in the closest travel position as an indicator of engine valve motion as illustrated in FIG. 4.

Preferably the spacer 38 is non-magnetic and sized to space the Hall effect sensor 36 and permanent magnet 34 such that the change in reluctance caused by the moving ferrous component, the shaft and spring retainer assembly 24, maximizes the gain in sensor linear output. Positioning the permanent magnet 34 to close to the Hall effect sensor 36 results in a flat line output as does positioning the magnet too far from the Hall effect sensor. The thickness of the spacer 38 can be determined empirically, since it will change with varying target shapes and materials.

The output of the Hall effect sensor 36 provides information about the entire valve lift profile. The positioning of the magnet 34, sensor 36, and spacer 38 assembly, at one end of the valve timing actuator 10, removed from the magnetic interference of the solenoids 18, 20 acting on the armature 12, provides very accurate output information about the valve V motion which can be used as input in a closed-loop feedback controlled, electromagnetic valve timing system.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of detecting engine valve motion in an internal combustion engine having an electromechanical valve actuator with a ferrous component that moves in a linear path with reciprocating motion of an engine valve between open and closed positions, the method comprising the steps of:

positioning a stationary magnetic field source with an axis aligned with said linear path and positioned such that at a closest position of travel of the ferrous component to said stationary magnetic field source alters the magnetic field flux;

providing a sensor in said linear path between said stationary magnetic field source and said ferrous component and sufficiently spaced from the magnetic field source to respond to an amplified change in magnetic field flux at said closest travel position of the ferrous component; and sensing the change in the magnetic field flux of said stationary magnetic field source caused by the presence and absence of said ferrous component in said closest travel position as an indicator of engine valve motion.

2. The method of claim 1 wherein said magnetic field source is a permanent magnet.

3. The method of claim 2 wherein said sensor is a Hall effect sensor.

4. The method of claim 3 further comprising the step of:

positioning a non-magnetic spacer between said Hall effect sensor and permanent magnet to ensure that the change in reluctance caused by the moving ferrous component maximizes the gain in the sensor linear output.

5. Apparatus for detecting engine valve motion in an internal combustion engine having an electromechanical valve actuator with a ferrous component that moves in a linear path with reciprocating motion of an engine valve between open and closed positions, the apparatus comprising:

a stationary magnetic field source mounted in said actuator and having an axis aligned with said linear path and positioned such that at a closest position of travel of the ferrous component to said stationary magnetic field source alters the magnetic field flux; and a sensor mounted in said linear path between said stationary magnetic field source and said ferrous component and sufficiently spaced from the magnetic field source to respond to an amplified change in magnetic field flux at said closest travel position;

wherein said sensor senses the change in the magnetic field flux of said stationary magnetic field source caused by the presence and absence of said ferrous component in said closest travel position as an indicator of engine valve motion.

6. The apparatus of claim 5 wherein said magnetic field source is a permanent magnet.

7. The apparatus of claim 6 wherein said sensor is a Hall effect sensor.

8. The apparatus of claim 7 including a non-magnetic spacer mounted between said magnetic field source and said sensor.

9. The apparatus of claim 5 wherein said ferrous component is a shaft and spring retainer assembly.

* * * * *